US006657649B2

(12) United States Patent
Odamura et al.

(10) Patent No.: US 6,657,649 B2
(45) Date of Patent: Dec. 2, 2003

(54) METHOD FOR IMAGE FORMATION AND INTERMEDIATE TRANSFER RECORDING MEDIUM FOR USE IN THE SAME

(75) Inventors: Kozo Odamura, Tokyo-To (JP); Katsuyuki Oshima, Tokyo-To (JP); Takayuki Imai, Tokyo-To (JP)

(73) Assignee: Dai Nippon Printing Co., Ltd. (JP)

( * ) Notice: Subject to any disclaimer, the term of this patent is extended or adjusted under 35 U.S.C. 154(b) by 0 days.

(21) Appl. No.: 10/144,757

(22) Filed: May 15, 2002

(65) Prior Publication Data

US 2003/0001942 A1 Jan. 2, 2003

(30) Foreign Application Priority Data

May 18, 2001 (JP) ..... 2001-148827

(51) Int. Cl.[7] ..... B41J 2/325
(52) U.S. Cl. ..... 347/213
(58) Field of Search ..... 347/213, 215; 503/227; 346/76.1, 135.1; 400/120.01

(56) References Cited

U.S. PATENT DOCUMENTS 5,398,051 A * 3/1995 Fukui et al. ..... 347/213
5,841,462 A * 11/1998 Matsuo et al. ..... 347/213
6,392,680 B2 * 5/2002 Akada et al. ..... 347/213

* cited by examiner

*Primary Examiner*—Lamson Nguyen
*Assistant Examiner*—K. Feggins
(74) *Attorney, Agent, or Firm*—Parkhurst & Wendel, L.L.P.

(57) ABSTRACT

The present invention to provide an intermediate transfer recording medium and a method for image formation using the same which, can prepare an object having whole plane image with no blank in the edge of the print, and can yield a thermally transferred image possessing excellent various fastness properties even under severe service conditions. A method for image formation, comprising the steps of: using an intermediate transfer recording medium comprising: a sheet substrate provided with a resin layer; and a transparent sheet provided with a receptive layer, the sheet substrate provided with the resin layer having been put on top of the transparent sheet provided with the receptive layer so that the transparent sheet faces the resin layer, forming a transfer image in said receptive layer, then retransferring the transfer image formed in said receptive layer onto an object, half-cutting said transparent sheet including the receptive layer, forming the transfer image in said receptive layer in an area equal to or larger than a whole area of the patch portion surrounded by the half cut, which is transferred when the transparent sheet including receptive layer is retransferred to the object, separating only the patch portion in the transparent sheet including the image-formed receptive layer from said resin layer, and retransferring the separated patch portion with no blank in the edge thereof onto the object.

5 Claims, 2 Drawing Sheets

METHOD FOR IMAGE FORMATION AND INTERMEDIATE TRANSFER RECORDING MEDIUM FOR USE IN THE SAME

BACKGROUND OF THE INVENTION

1. Field of the Invention

The present invention relates to a method for image formation and an intermediate transfer recording medium for use in the same which, by forming an image in an object using the intermediate transfer recording medium to form a protective layer on the image, can easily prepare a print with no blank in the edge thereof, that is, the print having a whole picture plane with no blank.

2. Prior Art

Various thermal transfer methods have hitherto been known in the art. In these thermal transfer methods, a thermal transfer sheet comprising a color transfer layer provided on a substrate sheet is image-wise heated from its backside, for example, by means of a thermal head to thermally transfer the color transfer layer onto the surface of a thermal transfer image-receiving sheet, thereby forming an image. The thermal transfer methods are roughly classified according to the construction of the color transfer layer into two methods, i.e., sublimation dye thermal transfer (sublimation-type thermal transfer) and thermal ink transfer (heat-fusion-type thermal transfer). For both the methods, full-color images can be formed. For example, a thermal transfer sheet comprising layers of three colors of yellow, magenta, and cyan or optionally four colors of yellow, magenta, cyan, and black is provided, and images of the individual colors are thermally transferred in a superimposition manner on the surface of an identical thermal transfer image-receiving sheet to form a full-color image. The development of various hardwares and softwares associated with multimedia has led to the expansion of the market of the thermal transfer method as a full-color hard copy system for computer graphics, static images through satellite communication, digital images typified, for example, by images of CD-ROMs (compact disc read only memory), and analog images, such as video images.

Specific applications of the thermal transfer image-receiving sheet used in the thermal transfer method are various, and representative examples thereof include proofs of printing, output of images, output of plans and designs, for example, in CAD/CAM, output of various medical analytical instruments and measuring instruments, such as CT scans and endoscope cameras, alternative to instant photographs, output and printing of photograph-like images of a face or the like onto identity certifications or ID cards, credit cards, and other cards, and composite photographs and commemorative photographs, for example, in amusement facilities, such as amusement parks, game centers (amusement arcades), museums, and aquaria. The diversification of the applications has led to an increasing demand for the formation of a thermally transferred image on a desired object. One method proposed for meeting this demand comprises the steps: providing an intermediate transfer recording medium comprising a substrate and a receptive layer separably provided on the substrate; providing a thermal transfer sheet having a dye layer; transferring the dye from the thermal transfer sheet to the receptive layer in the intermediate transfer recording medium to form an image on the receptive layer; and then heating the intermediate transfer recording medium to transfer the receptive layer onto an object (see Japanese Patent Laid-Open No. 238791/1987).

When the thermal transfer images are formed for such these applications and an thermal transfer image is formed in an image-receiving sheet, a blank portion having no recording-image is usually formed around the image-receiving sheet, to prevent from smudging a platen for recording in a thermal transfer printer and smudging thermal transfer sheet with a colored transfer layer, or to carry a receiving sheet with such as a gripper, pinch roller and carrying roller.

Accordingly, for a receiving sheet of thermal transfer image, a print like a silver-salt picture which has recording image in a whole plane of an image-receiving sheet can not be prepared.

SUMMARY OF THE INVENTION

Accordingly, in order to solve the above problems of the prior art, it is an object of the present invention to provide an intermediate transfer recording medium and a method for image formation using the same which, by forming an whole plane image with no blank in transferred portion (patch portion) and retransferring the patch portion onto an object, can prepare an object having whole plane image with no blank in the edge of the print, and can yield a thermally transferred image possessing excellent various fastness properties even under severe service conditions.

Thus, the prevent invention provides A method for image formation, comprising the steps of: using an intermediate transfer recording medium comprising: a sheet substrate provided with a resin layer; and a transparent sheet provided with a receptive layer, the sheet substrate provided with the resin layer having been put on top of the transparent sheet provided with the receptive layer so that the transparent sheet faces the resin layer, forming a transfer image in said receptive layer, then retransferring the transfer image formed in said receptive layer onto an object, half-cutting said transparent sheet including the receptive layer, forming the transfer image in said receptive layer in an area equal to or larger than a whole area of the patch portion surrounded by the half cut, which is transferred when the transparent sheet including receptive layer is retransferred to the object, separating only the patch portion in the transparent sheet including the image-formed receptive layer from said resin layer, and retransferring the separated patch portion with no blank in the edge thereof onto the object. In this case, the print which has a whole image without flames can be prepared. In addition, since the transparent sheet as a protective sheet is provided onto an image of a print, a thermally transferred image which possesses excellent various fastness properties even under severe service conditions can be provided.

Further, in the embodiment of the present invention, the surface area of the patch portion is preferably smaller than or equal to the whole surface area of the portion transferred to the object. In this case, the patch portion does not project from the edge of the object.

The patch portion preferably has a partially removed portion relative to the object. According to this construction, for example, the position of a sign panel, an IC chip, or a magnetic stripe in the object, or the position of a design portion such as a logo or a hologram which has been previously printed on the object, can be registered with the partially removed portion followed by retransfer of the patch onto the object. In sign panel, IC chip, magnetic stripe and other portions, a deterioration in properties by post treatment of these portion can be prevented. In logo, hologram and other design portions, the formation of an image in these portions lowers the transparency, that is, increases opaqueness, and thus deteriorates the quality of the image. For this reason, the design portion is provided outside the image formation portion. The sign panel portion is a portion where handwriting with a writing instrument, such as a ballpoint pen, numbering with a stamp ink, and sealing with a vermilion inkpad are performed.

Further, Intermediate transfer recording medium of the prevent invention comprising the sheet substrate provided with the resin layer; and a transparent sheet provided with a receptive layer, the sheet substrate provided with the resin layer having been put on top of the transparent sheet provided with the receptive layer so that the transparent sheet faces the resin layer, said transfer image being formed in said receptive layer, said transparent sheet including the receptive layer being half-cut, said transfer image being formed in said receptive layer in an area equal to or larger than a whole area of the patch portion surrounded by the half cut, which is transferred when the transparent sheet including receptive layer is retransferred to the object, only said patch portion in the transparent sheet including the image-formed receptive layer being separated from said resin layer, and said separated patch portion with no blank in the edge thereof being retransferred onto the object.

Further, the total width of the intermediate transfer recording medium is preferably larger than the width of the object in its face on which the image is to be transferred. According to this construction, when an image is formed on the receptive layer in the intermediate transfer recording medium followed by the transfer of the image formation portion onto the object, direct contact of a heating device, such as a thermal head or a pressing roll, or a press plate, with the object can be avoided and, thus, damage to the object can be prevented.

DETAILED DESCRIPTION OF THE INVENTION

Figure 1A:
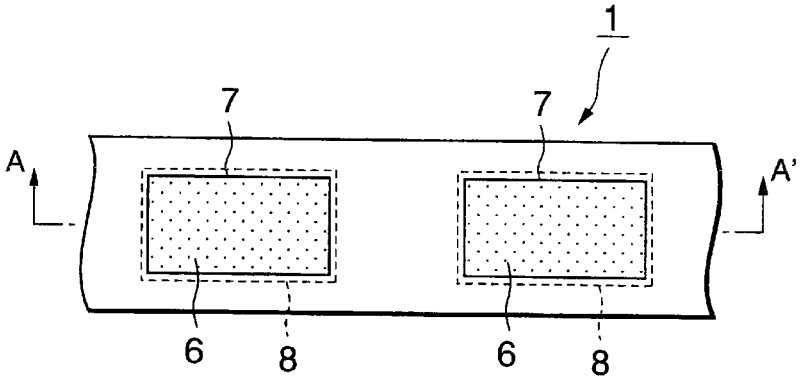
FIG. 1A is a schematic plan view showing one embodiment of the intermediate transfer recording medium according to the present invention.
Figure 2:
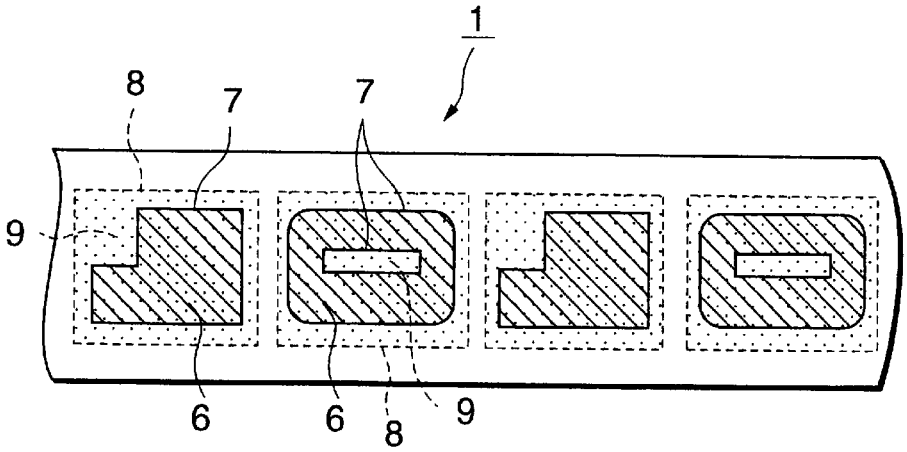
FIG. 2 is a schematic plan view showing another embodiment of the intermediate transfer recording medium according to the present invention.

FIG. 1A is a schematic plan view showing one embodiment of an intermediate transfer recording medium 1 according to the present invention and FIG. 2 is a schematic cross-sectional view showing one embodiment of the intermediate transfer recording medium 1 of FIG. 1A. The intermediate transfer recording medium 1 comprises: a sheet substrate 4 having thereon a resin layer 5; and a transparent sheet 2 having thereon a receptive layer 3, the transparent sheet 2 provided with the receptive layer 3 having been stacked on the sheet substrate 4 provided with the resin layer 5 so that the resin layer 5 is separable from the transparent sheet 2, the transparent sheet 2 including the receptive layer 3 having been subjected to half cutting 7. The region surrounded by the half cutting 7 is patch portion 6. An image 8 is formed in the area larger than the patch portion 6. There are no blank in the outer edge of the patch portion 6. The patch portion 6 is retransferred onto the object to provide a print having no flames. Further, the image is formed in the whole area corresponding to the shape of the region surrounded half cut 7 in the patch portion 6, that is, the whole surface area of the receptive layer corresponding to the shape of the patch portion. In this case, there are no blank in the outer edge of the patch portion, which can be retransferred to the object.

FIG. 2 is a schematic plan view showing a further embodiment of the intermediate transfer recording medium 1 according to the present invention. The intermediate transfer recording medium 1 comprises: a transparent sheet having thereon a receptive layer; and a sheet substrate, the transparent sheet having been separably stacked on the substrate sheet through a resin layer. The transparent sheet portion including the receptive layer has been subjected to half cutting 7. As the boundary of the half cut portion 7, the shape of the patch portion 6 are a quadrangle removed central portion and L shape removed one corner of quadrangle as shown in FIG. 2. This patch portion 6 is retransferred onto the object to form a portion 9 which has a blank part. A patch portion 6 as the image forming portion is left using the half cut portion 7 as the boundary between the removal portion and the image forming portion remaining unremoved, and, as shown in the drawing, the outside of the patch portion 6 and the inside removal portion surrounded by the patch portion 6 are separated and removed.

Upon the retransfer of this patch portion 6 onto an object, the patch portion 6 has a partially removed portion 9 relative to the object. In this case, a portion where the formation of no image as the patch portion is desired, such as a hologram portion or a logo portion in an object, for example, a sign panel, an IC chip, a magnetic stripe, or a credit card, is registered with the partially removed portion 9. By virtue of this, any image is not present at all in a position where the formation of no image is contemplated. Thus, the occurrence of troubles after retransfer can be prevented.

Further, according to intermediate transfer recording medium 1 shown in FIG. 2, the image 8 is formed in the area larger than patch portion 6 in the transparent sheet portion providing receptive layer separated by the half cut 7.

Transparent Sheet

In the transparent sheet 2 used in the intermediate transfer recording medium according to the present invention, the transparent sheet portion is cut using the half cut portion as the boundary between the removal portion and the portion remaining unremoved, and the transparent sheet can function as a protective layer in such a state that the transparent sheet covers the surface of the image formed portion. The transparent sheet may be any one so far as the sheet is transparent and has fastness properties, such as weathering resistance, abrasion resistance, and chemical resistance. Examples of transparent sheets usable herein include about 0.5 to 100 μm-thick, preferably about 10 to 40 μm-thick, films of polyethylene terephthalate, 1,4-polycyclohexylene dimethylene terephthalate, polyethylene naphthalate, polyphenylene sulfide, polystyrene, polypropylene, polysulfone, aramid, polycarbonate, polyvinyl alcohol, cellulose derivatives, such as cellophane and cellulose acetate, polyethylene, polyvinyl chloride, nylon, polyimide, and ionomer.

The transparent sheet in its side facing the resin layer may be subjected to release treatment to facilitate the separation of the transparent sheet from the resin layer. In the release treatment, a release layer is provided on the transparent sheet. The release layer may be formed by coating a coating liquid containing, for example, a wax, silicone wax, a silicone resin, a fluororesin, an acrylic resin, a polyvinyl alcohol resin, or a cellulose derivative resin or a copolymer of monomers constituting the above group of resins onto the transparent sheet by conventional means, such as gravure printing, screen printing, or reverse roll coating using a gravure plate, and drying the coating. The coverage of the release layer is about 0.1 to 10 g/m$^2$ on a dry basis.

Receptive Layer

The receptive layer 3 may be formed on the transparent sheet either directly or through a primer layer. The construction of the receptive layer 3 varies depending upon the recording system, that is, whether the recording system is thermal ink transfer recording or sublimation dye transfer recording. In the thermal ink transfer recording, a method may also be adopted wherein a color transfer layer is thermally transferred from the thermal transfer sheet directly onto the transparent sheet without providing the receptive layer. In the thermal ink transfer recording and the sublimation dye transfer recording, the receptive layer functions to receive a colorant thermally transferred from the thermal transfer sheet. In particular, in the case of the sublimable dye, preferably, the receptive layer receives the dye, develops a color, and, at the same time, does not permit re-sublimation of the once received dye. A transfer image is formed on a receptive layer in an intermediate transfer recording medium, and only the image formed portion is retransferred onto an object to form an image on the object. The receptive layer according to the present invention is generally transparent so that an image transferred onto the object can be clearly viewed from the top. However, the retransferred image can be made impressive by intentionally making the receptive layer opaque or by intentionally lightly coloring the receptive layer.

The receptive layer is generally composed mainly of a thermoplastic resin. Examples of materials usable for forming the receptive layer include: polyolefin resins such as polypropylene; halogenated polymers such as vinyl chloride-vinyl acetate copolymer, ethylene-vinyl acetate copolymer, and polyvinylidene chloride; polyester resins such as polyvinyl acetate and polyacrylic esters; polystyrene resins; polyamide resins; copolymer resins produced from olefins, such as ethylene and propylene, and other vinyl monomers; ionomers; cellulosic resins such as cellulose diacetate; and polycarbonate resins. Among them, polyester resins and vinyl chloride-vinyl acetate copolymer and mixtures of these resins are particularly preferred.

In sublimation transfer recording, a release agent may be incorporated into the receptive layer, for example, from the viewpoint of preventing fusing between the thermal transfer sheet having a color transfer layer and the receptive layer in the intermediate transfer recording medium at the time of image formation or preventing a lowering in sensitivity in printing and the like. Preferred release agents usable as a mixture include silicone oils, phosphoric ester surfactants, and fluorosurfactants. Among them, silicone oils are preferred. Preferred silicone oils include epoxy-modified, vinyl-modified, alkyl-modified, amino-modified, carboxyl-modified, alcohol-modified, fluorine-modified, alkyl aralkyl polyether-modified, epoxy-polyether-modified, polyether-modified and other modified silicone oils.

A single or plurality of release agents may be used. The amount of the release agent added is preferably 0.5 to 30 parts by weight based on 100 parts by weight of the resin for the receptive layer. When the amount of the release agent added is outside the above amount range, problems sometimes occur such as fusing between the sublimation-type thermal transfer sheet and the receptive layer in the intermediate transfer recording medium or a lowering in sensitivity in printing. The addition of the release agent to the receptive layer permits the release agent to bleed out on the surface of the receptive layer after the transfer to form a release layer. Alternatively, these release agents may be separately coated onto the receptive layer without being incorporated into the receptive layer. The receptive layer may be formed by coating a solution of a mixture of the above resin with necessary additives, such as a release agent, in a suitable organic solvent, or a dispersion of the mixture in an organic solvent or water onto a transparent sheet by conventional forming means such as gravure coating, gravure reverse coating, or roll coating, and drying the coating. The receptive layer may be formed at any coverage. In general, however, the coverage of the receptive layer is 1 to 50 g/m$^2$ on a dry basis. The receptive layer is preferably in the form of a continuous coating. However, the receptive layer may be in the form of a discontinuous coating formed using a resin emulsion, a water-soluble resin, or a resin dispersion. Further, an antistatic agent may be coated onto the receptive layer from the viewpoint of realizing stable carrying of sheets through a thermal transfer printer.

Sheet Substrate

The sheet substrate 4 used in the present invention is not particularly limited, and examples thereof include, for example: capacitor paper, glassine paper, parchment paper, or paper having a high sizing degree, synthetic paper (such as polyolefin synthetic paper and polystyrene synthetic paper), cellulose fiber paper, such as wood free paper, art paper, coated paper, cast coated paper, wall paper, backing paper, synthetic resin- or emulsion-impregnated paper, synthetic rubber latex-impregnated paper, paper with synthetic resin internally added thereto, and paperboard; and films of polyester, polyacrylate, polycarbonate, polyurethane, polyimide, polyether imides, cellulose derivative, polyethylene, ethylene-vinyl acetate copolymer, polypropylene, polystyrene, acrylic resin, polyvinyl chloride, polyvinylidene chloride, polyvinyl alcohol, polyvinyl butyral, nylon, polyether ether ketone, polysulfone, polyether sulfone, tetrafluoroethylene-perfluoroalkyl vinyl ether, polyvinyl fluoride, tetrafluoroethylene-ethylene, tetrafluoroethylene-hexafluoropropylene, polychlorotrifluoroethylene, polyvinylidene fluoride and the like.

The thickness of the sheet substrate is preferably 10 to 100 $\mu$m. When the sheet substrate is excessively thin, the resultant intermediate transfer recording medium is not sturdy and thus cannot be carried by means of a thermal transfer printer or is disadvantageously curled or cockled. On the other hand, when the sheet substrate is excessively thick, the resultant intermediate transfer recording medium is excessively thick. In this case, the driving force of the thermal transfer printer necessary for carrying the intermediate transfer recording medium is excessively large, resulting in a printer trouble or a failure of the intermediate transfer recording medium to be normally carried.

Resin Layer

The resin layer 5 may be provided as a pressure-sensitive adhesive layer, an easy-adhesion adhesive layer, or an extrusion coating (EC) on the sheet substrate.

The pressure-sensitive adhesive layer may be formed of any conventional solvent-type or aqueous pressure-sensitive adhesive. Pressure-sensitive adhesives include, for example, vinyl acetate resins, acrylic resins, vinyl acetate-acryl copolymers, vinyl acetate-vinyl chloride copolymers, ethylene-vinyl acetate copolymers, polyurethane resins, naturally occurring rubbers, chloroprene rubbers, and nitrile rubbers may be mentioned as the pressure-sensitive adhesive. The coverage of the pressure-sensitive adhesive layer is generally about 8 to 30 g/m$^2$ on a solid basis, and the pressure-sensitive adhesive layer may be formed by coating the pressure-sensitive adhesive by a conventional method, for example, gravure coating, gravure reverse coating, roll coating, Komma coating, or die coating, on a release sheet and drying the coating. Further an adhesion force of the pressure-sensitive adhesive layer, that is, the peel force for separating the transparent sheet from the pressure-sensitive adhesive layer, should be noted in the range of 5 to 1000 gf/inch as measured by the 180-degree peel method according to JIS Z 0237. In the formation of the pressure-sensitive adhesive layer on the sheet substrate, the above-described type of adhesive and coverage are preferably selected so that the peel strength is in the above-defined range.

When the pressure-sensitive adhesive layer is provided on the sheet substrate and the transparent sheet is stacked onto the pressure-sensitive adhesive layer, a method may be adopted such as dry lamination or hot-melt lamination of the pressure-sensitive adhesive layer.

In the formation of the easy-adhesion adhesive layer, preferably, a latex of styrene-butadiene copolymer rubber (SBR), an acrylic resin, such as acrylonitrile-butadiene copolymer rubber (NBR) or a polyacrylic ester, a rubbery resin, a wax, or a mixture of two or more of the above materials is coated onto a sheet substrate by a conventional coating method, and the easy-adhesion adhesive layer is then stacked onto the transparent sheet by dry lamination with heating. The easy-adhesion adhesive layer after the separation of the transparent sheet from the sheet substrate has lowered tackiness and no longer can be used in the application of the transparent sheet to the sheet substrate. When this easy-adhesion adhesive layer is used, a primer layer may be provided between the sheet substrate and the easy-adhesion adhesive layer.

Further, an EC layer may be provided as the resin layer according to the present invention on the sheet substrate. The thermoplastic resin used for forming the EC layer is not particularly limited so far as the resin is not virtually adhered to the transparent sheet and is extrudable. In particular, however, a polyolefin resin is preferred which is not virtually adhered to PET films generally utilized in the transparent sheet and has excellent processability. More specifically, for example, LDPE, MDPE, HDPE, and PP resins are usable. In extrusion coating these resins, when a matte roll is used as a cooling roll, the matte face may be transferred onto the surface of the EC layer, whereby fine concaves and convexes can be formed to render the EC layer opaque. Alternatively, a method may be used wherein a white pigment, such as calcium carbonate or titanium oxide, is mixed into the polyolefin resin to form an opaque EC layer. The EC layer may be either a single-layer structure or a multi-layer structure of two or more layers. The peel strength of the EC layer from the transparent sheet may be regulated according to the processing temperature in the extrusion and the type of the resin. Thus, simultaneously with the extrusion of the EC layer on the sheet substrate, the sheet substrate can be stacked onto the transparent sheet through the EC layer by the so-called "EC lamination."

In providing the resin layer on the sheet substrate, a primer layer may be provided on the surface of the sheet substrate to improve the adhesion between the sheet substrate and the resin layer. Instead of the provision of the primer layer, the surface of the sheet substrate may be subjected to corona discharge treatment. The primer layer may be formed by providing a coating liquid in the form of a solution or dispersion of a polyester resin, a polyacrylic ester resin, a polyvinyl acetate resin, a polyurethane resin, a polyamide resin, a polyethylene resin, a polypropylene resin or the like in a solvent and coating the coating liquid by the same means as used in the formation of the receptive layer. The thickness of the primer layer is about 0.1 to 5 g/m$^2$ on a dry basis. The primer layer may also be formed between the transparent sheet and the receptive layer in the same manner as described above.

In the intermediate transfer recording medium according to the present invention, if necessary, a heat-resistant slip layer may be provided on the backside of the sheet substrate, that is, on the sheet substrate in its side remote from the resin layer, from the viewpoint of preventing adverse effect, such as sticking, caused by heat of a thermal head, a heat roll or the like as means for retransferring the image formed portion onto an object, or cockling.

Any conventional resin may be used as the resin for constituting the heat-resistant slip layer, and examples thereof include polyvinyl butyral resins, polyvinyl acetoacetal resins, polyester resins, vinyl chloride-vinyl acetate copolymers, polyether resins, polybutadiene resins, styrene-butadiene copolymers, acrylic polyols, polyurethane acrylates, polyester acrylates, polyether acrylates, epoxy acrylates, prepolymers of urethane or epoxy, nitrocellulose resins, cellulose nitrate resins, cellulose acetopropionate resins, cellulose acetate butyrate resins, cellulose acetate hydrodiene phthalate resins, cellulose acetate resins, aromatic polyamide resins, polyimide resins, polycarbonate resins, chlorinated polyolefin resins, and chlorinated polyolefin resins.

Slipperiness-imparting agents added to or top-coated on the heat-resistant slip layer formed of the above resin include phosphoric esters, silicone oils, graphite powder, silicone graft polymers, fluoro graft polymers, acrylsilicone graft polymers, acrylsiloxanes, arylsiloxanes, and other silicone polymers. Preferred is a layer formed of a polyol, for example, a high-molecular polyalochol compound, a polyisocyanate compound and a phosphoric ester compound. Further, the addition of a filler is more preferred.

The heat-resistant slip layer may be formed by dissolving or dispersing the resin, the slipperiness-imparting agent, and a filler in a suitable solvent to prepare an ink for the formation of a heat-resistant slip layer, coating the ink onto the backside of the substrate sheet by forming means, such as gravure printing, screen printing, or reverse coating using a gravure plate, and drying the coating.

The intermediate transfer recording medium according to the present invention comprises at least a receptive layer, a transparent sheet, a resin layer, and a sheet substrate. An antistatic layer may be provided on the surface of the receptive layer, the backside of the sheet substrate, or the outermost surface of both sides. The antistatic layer may be formed by coating a solution or dispersion of an antistatic agent, such as a fatty ester, a sulfuric ester, a phosphoric ester, an amide, a quaternary ammonium salt, a betaine, an amino acid, an acrylic resin, or an ethylene oxide adduct, in a solvent. The forming means used may be the same as that used in the formation of the receptive layer. The coverage of the antistatic layer is preferably 0.001 to 0.1 g/m$^2$ on a dry basis.

An intermediate layer formed of one of various resins may be provided between the substrate and the receptive layer in the transparent sheet. In this case, the intermediate layer is preferably transparent so that the retransferred image can be viewed. When the intermediate layer has various functions, excellent functions can be imparted to the image-receiving sheet. For example, a highly elastically deformable or plastically deformable resin, for example, a polyolefin resin, a vinyl copolymer resin, a polyurethane resin, or a polyamide resin, may be used as a cushioning property-imparting resin to improve the sensitivity in printing of the image-receiving sheet or to prevent harshness of images. Further, antistatic properties may be imparted to the intermediate layer by adding the antistatic agent to the cushioning property-imparting resin, dissolving or dispersing the mixture in a solvent, and coating the solution or dispersion to form an intermediate layer.

Half Cutting

In the intermediate transfer recording medium according to the present invention, the transparent sheet portion including the receptive layer has been subjected to half cutting 7. The half cut may be formed by any method without particular limitation so far as half cutting is possible. Examples of methods usable for half cutting include a method wherein the intermediate transfer recording medium is inserted into between an upper die provided with a cutter blade and a pedestal and the upper die is then vertically moved, a method wherein a cylinder-type rotary cutter is used, and a method wherein heat treatment is carried out by means of a laser beam.

The image is formed in the whole area of the patch portion surrounded by the half cut or the area larger than the patch portion. A thermal transfer image is transferred near to the half cut portion or onto the one. Thus, the methods for half cutting preferably are used by means of cutter Knives with sharp edge or a laser beam to prevent from pebbling the receptive layer.

Figure 1B:
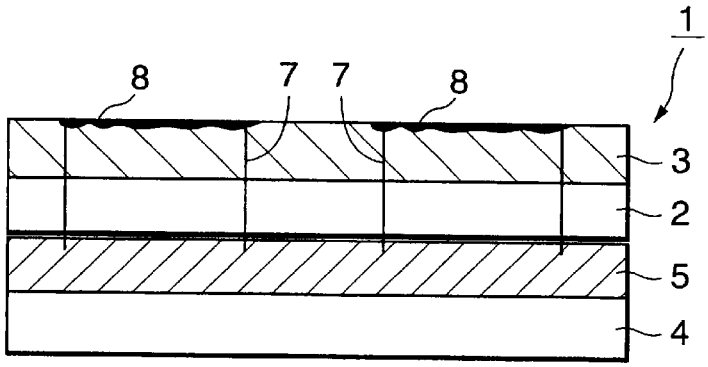
FIG. 1B is a schematic cross-sectional view showing one embodiment of the intermediate transfer recording medium of FIG. 1A.

As shown in FIGS. 1A and 1B, a layer order of the patch portion 6 surrounded by the half cut 7 and the portion except for the patch portion 6, that is near to the patch portion, is equal. The transparent sheet including receptive layer previously may be separated at the portion except for the patch portion. In this case, at the time of image formation, the receptive layer 3 provided on the transparent sheet 2 is left only in the patch portion 6. The removal of refuse in this way can eliminate a fear of the transparent sheet portion being cut by the half cut portion at the time of the retransfer of the image onto the object. Thus, the patch portion (image formed portion) can be surely transferred onto the object.

Regarding the half cut portion 7, it is common practice to continuously provide a cut, one round by one round, around the image forming portion. In this case, an uncut (no cut) portion may be partially provided, for example, at four corners, to prevent the trouble of separation of the half cut portion during handling, for example, during carriage through a thermal transfer printer. However, it should be noted that, in order that, at the time of the retransfer of the patch portion that is the region surrounded by the half cut, the uncut portion is melt cut and the portion surrounded by the continuous half cut portion including the melt cut portion is transferred onto the object, the length of the uncut is preferably small and about 0.1 to 0.5 mm. Alternatively, perforation, such that half cuts and uncuts are alternately provided, may be provided. In the case of the perforation, for example, preferably, the length of the cut portion is about 2 to 5 mm, and the length of the uncut portion is about 0.1 to 0.5 mm. Examples of methods usable for the formation of the perforation include a method wherein the intermediate transfer recording medium is inserted into between an upper die provided with a perforating blade and a pedestal and the upper die is then vertically moved and a method wherein a cylinder-type rotary cutter is used.

At the time of half cutting, when the depth of the cut portion is excessively large in the depth direction, that is, when not only the transparent sheet portion but also the sheet substrate is cut, the intermediate transfer recording medium is cut at the half cut portion during carriage in the printer, often leading to carriage troubles. On the other hand, at the time of half cutting, when the cut level is excessively low in the depth direction, for example, when a half cut is provided only in the receptive layer without the provision of a half cut in the transparent sheet, the resin layer and the transparent sheet cannot be separated from each other at the time of the retransfer of the patch portion onto an object. Therefore, as shown in FIGS. 1A and 1B, the depth of the half cutting is preferably on a level such that passes through the receptive layer and the transparent sheet and slightly bites the resin layer in the thicknesswise direction. Preferably, the half cutting according to the present invention is previously carried out before the formation of an image on the receptive layer in the intermediate transfer recording medium. However, alternatively, the half cutting may be carried out according to the image region after the formation of an image on the receptive layer in the intermediate transfer recording medium.

Production Process of Intermediate Transfer Recording Medium

One of production processes of the intermediate transfer recording medium according to the present invention is a process for producing an intermediate transfer recording medium comprising a sheet substrate provided with a resin layer and a transparent sheet provided with a receptive layer, the transparent sheet provided with the receptive layer having been put on top of the sheet substrate provided with the resin layer so that the transparent sheet faces the resin layer, said process comprising the steps of: coating a receptive layer onto a transparent sheet; applying the transparent sheet on its side remote from the receptive layer onto a sheet substrate, in which register marks have been previously provided at positions corresponding to respective screen units, through a resin layer; and then reading the register marks to perform registration for half cutting and then to perform half cutting.

One of production processes of the intermediate transfer recording medium according to the present invention will be described with reference to FIG. 3.

At the outset, as shown in FIG. 3, a receptive layer 3 is formed on a transparent sheet 2 by coating and drying in a conventional manner.

Figure 3A:
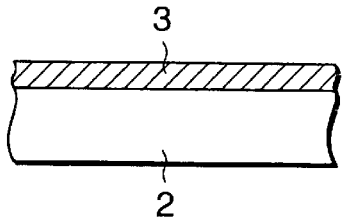
FIGS. 3A to 3D are schematic diagrams showing another embodiment of the production process of an intermediate transfer recording medium according to the present invention.
Figure 3B:
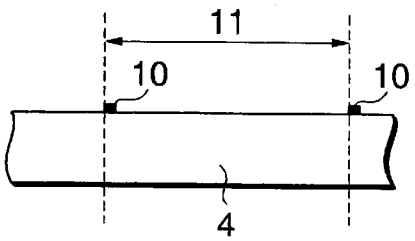

As shown in FIG. 3B, register marks 10 are repeatedly provided on a sheet substrate 4 for each screen unit 11. The register marks 10 may be formed by any method, and examples of methods usable herein include gravure printing or offset printing, the provision of a deposit film by hot stamping using a transfer foil, the application of a deposit film provided with a pressure-sensitive adhesive on the backside of the sheet substrate, and the provision of through holes which extend from the surface to the backside of the sheet substrate 4. In this case, the register marks 10 are provided while leaving a space for each screen unit 11.

For example, the shape or the color of the register mark is not limited so far as the register mark is detectable with a detector. Examples of shapes of the register mark include quadrangle, circle, bar cord, and line extending from end to end in the widthwise direction of the intermediate transfer recording medium. The color of the register mark may be any one detectable with a detector. For example, when a light transmission detector is used, silver, black and other colors having a high level of opaqueness may be mentioned as the color of the register mark. On the other hand, when a light reflection detector is used, for example, a highly light reflective metalescent color may be mentioned as the color of the register mark.

A hologram mark (a mark having a hologram pattern) may be used as the register mark. The hologram mark may be formed by any conventional method for the formation of a hologram pattern, for example, by providing an original plate having a concave-convex pattern of interference fringes of a hologram and forming fine concaves and convexes by embossing. The so-called "hologram sensor" may be utilized as a sensor for the hologram mark. In this sensor, light emitted from a light emitting device is irregularly reflected from the hologram mark and emits diffracted light which can be then detected with a photodetector to detect the position of the hologram mark.

The position of the register mark is not limited to the position shown in the drawing. For example, when the sheet substrate is transparent, the register mark may be provided on the sheet substrate in its side remote from the side on which the resin layer is to be formed.

Figure 3C:
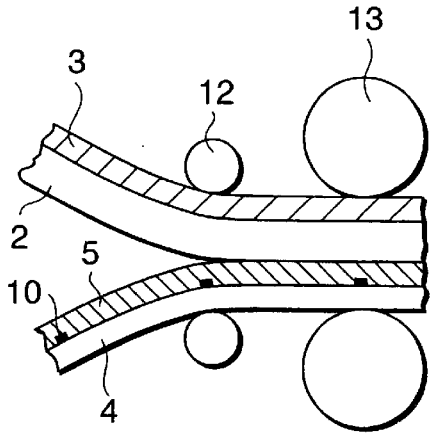

FIG. 3C is a schematic diagram illustrating the step of laminating the assembly, comprising the receptive layer 3 provided on the transparent sheet 2 as described above in conjunction with FIG. 3A, onto the sheet substrate 4 provided with the register mark 10 as described above in conjunction with FIG. 3B through a resin layer 5 so that the transparent sheet 2 on its side remote from the receptive layer 3 faces the sheet substrate 4 on its register mark 10 side.

In this lamination, the transparent sheet 2 side and the sheet substrate 4 side are guided by means of guide rolls 12 and are put on top of each other. In this case, a resin layer 5 is previously formed by coating on the sheet substrate by a conventional method although this is not shown in the drawing.

In this way, the transparent sheet 2 side and the sheet substrate 4 side are put on top of each other through the resin layer 5, and both the assemblies are pressed by laminate rolls 13 optionally with heating and are consequently laminated to form an integral structure.

The resin layer may be in the form of a pressure-sensitive adhesive layer, an easy-adhesion adhesive layer, or an extrusion coating (EC), and lamination methods, such as dry lamination, hot-melt lamination, and EC lamination, may be used according to the form of the resin layer.

In the embodiment shown in FIG. 3C, the resin layer 5 is coated onto the sheet substrate 4, and the transparent sheet 2 side and the sheet substrate 4 side are laminated onto each other through the resin layer 5. Alternatively, a method may also be used wherein the resin layer is coated on the transparent sheet side and the transparent sheet side and the sheet substrate side are laminated onto each other through the resin layer.

As shown in the drawing, in a construction such that the register mark 10 comes into direct contact with the resin layer 5, for example, when an aqueous solvent is used in the coating liquid for the resin layer, it is important that a solvent, such as toluene or methyl ethyl ketone, be used in the coating liquid for the register mark from the viewpoint of rendering the register mark and the resin layer incompatible with each other at the time of the lamination of the sheet substrate and the transparent sheet through the resin layer. The reason for this is as follows. When the register mark is incompatible with the layer in contact with the register mark, adverse effect on the register mark print portion, such as bleeding of the register mark or trapping, can be avoided.

Figure 3D:
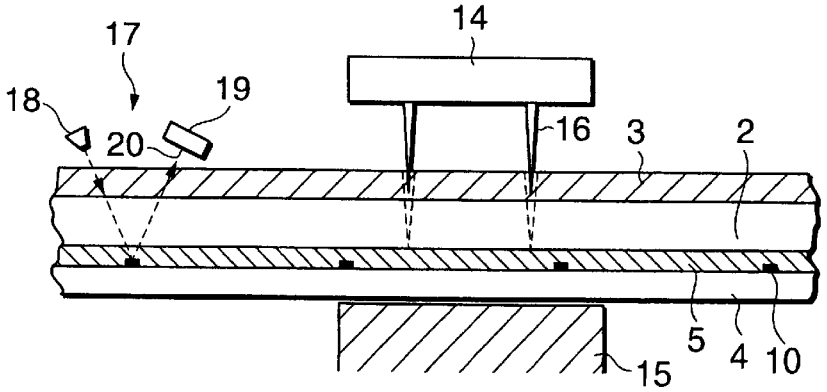

As shown in FIG. 3D, the intermediate transfer recording medium 1 produced by providing the receptive layer 3 on the transparent sheet 2 and laminating the transparent sheet 2 on its side remote from the receptive layer 3 onto the sheet substrate 4, provided with the register mark 10, through the resin layer 5, is subjected to half cutting using an upper die 14, provided with a half cutting blade 16 having predetermined size and pattern, and a pedestal 15.

Specifically, the intermediate transfer recording medium 1 is placed between the upper die 14, provided with the cutter blade 16, and the pedestal 15, and the upper die 14 is pressed toward the pedestal 15 to perform half cutting 7 in the intermediate transfer recording medium 1.

This half cutting should be carried out at predetermined positions in the intermediate transfer recording medium 1. To this end, the register mark 10 provided in the intermediate transfer recording medium is read by a specialty detector 14 for register mark reading, and, in synchronization with the read signal, the upper die 14 provided with the cutter blade 16 is dropped toward the pedestal 15. The registration for half cutting 7 is then carried out followed by half cutting 7.

Regarding the detector 17 shown in the drawing, light emitted from a light emitting device 18 is reflected from the register mark 10 provided in the intermediate transfer recording medium 1, and the reflected light 20 is detected with a photodetector 19 to detect the position of the register mark 10. In this embodiment, the register mark is detected with a light reflection sensor. The detection method, however, is not limited to this only. Specifically, a transmission sensor may also be utilized wherein a light emitting device provided on one side of the intermediate transfer recording medium emits light toward the register mark, and the transmitted light is detected with a photodetector provided on the other side of the intermediate transfer recording medium.

In the transfer of the patch portion onto the object, the area of the patch portion is smaller than or equal to the total transfer area of the object. In order to avoid an unfavorable phenomenon such that the end of the patch portion is transferred onto the object and is projected from the object to a noticeable extent, the patch portion as the image forming portion is preferably smaller than the total transfer area of the object by one to several dots or by about 0.5 to 2 mm in terms of the end portion length.

In connection with the size of the transfer face, the total width of the intermediate transfer recording medium is preferably larger than the width of the transfer face of the object. In this case, when an image is formed on the receptive layer of the intermediate transfer recording medium followed by the transfer of the image formed portion onto the object, the object does not come into direct contact with a heating device, such as a thermal head, a press roll, or a press plate. Therefore, damage to the object can be prevented.

Method for Image Formation

The method for image formation according to the present invention comprises the steps of: providing the above intermediate transfer recording medium; transferring an image onto the receptive layer in the intermediate transfer recording medium to form an image on the receptive layer; and thus retransferring the transfer image formed onto the receptive layer to form an image on the object;

As shown in FIGS. 1A and 1B, if the patch portion is simple in shape, an image can be formed in whole area of the region of the only patch portion in the transparent sheet provided receptive layer. However, as show in FIG. 2, if the patch portion is complicated in shape like complicated outline of the patch portion, the image is preferred formed in an area larger than the patch portion.

In the thermal transfer recording method for forming an image on the receptive layer, thermal energy controlled by an image signal is generated by means of a thermal head and is used as activation energy of a recoding material such as ink. In this method, a thermal transfer sheet comprising a thermally transferable colorant layer provided on a substrate sheet is put on top of recording paper. The assembly is passed through between a thermal head and a platen under suitable pressure, and the recording material is activated by the thermal head at a temperature increased by energization and is transferred onto the recording paper with the aid of pressure of the platen.

The transfer recording method is classified into sublimation dye thermal transfer (sublimation-type thermal transfer) and thermal ink transfer (hot melt-type thermal transfer). Both the types can be used in the formation of an image on an object according to the present invention. Further, the sublimation dye thermal transfer may be used in combination with the thermal ink transfer. In this case, for example, a halftone image may be formed by the sublimation dye thermal transfer recording while forming character images by the thermal ink transfer recording.

The thermal transfer recording can be carried out by the thermal head, as well as by thermal transfer means utilizing laser beam irradiation heating.

At the time of the thermal transfer recording, the intermediate transfer recording medium used is preferably such that a register mark is provided in the intermediate transfer recording medium and half cutting has been performed based on the register mark. This register mark is detected to register the position of the thermal transfer image on the intermediate transfer recording medium.

According to the present invention, examples of means usable for retransferring the patch portion onto an object include: one wherein the object and the intermediate transfer recording medium with an image formed thereon are sandwiched between a thermal head and a platen and the assembly is heated by the thermal head; one wherein a heat roll system is used (a commercially available laminator is in many cases of this type wherein hot pressing is carried out by a pair of heat rolls); one wherein the object and the intermediate transfer recording medium are sandwiched between a heated flat plate and a flat plate or between a heated flat plate and a roll followed by hot pressing; and one wherein thermal transfer is carried out by heating utilizing laser beam irradiation.

When the thermal head is used as means for retransferring the image onto the object, the thermal head may be the same as used in the image formation, or alternatively, may be different from the thermal head used in the image formation. In the method for image formation according to the present invention, however, the thermal transfer means for image formation and the means for the retransfer of the image onto the object are preferably carried out on an in-line basis by means of one thermal transfer printer from the viewpoint of efficiency.

At the time of the retransfer, as with the thermal transfer recording, the register mark provided in the intermediate transfer recording medium is preferably detected to register the position of the thermal transfer image on the intermediate transfer recording medium with the position of the object.

EXAMPLES

The following examples further illustrate the present invention. In the following description, "parts" or "%" is by weight unless otherwise specified.

Example 1

The following coating liquid for a receptive layer was first coated on a 25 μm-thick polyethylene terephthalate film (Lumirror, manufactured by Toray Industries, Inc.) as a transparent sheet, and the coating was dried to form a receptive layer at a coverage of 3.0 g/m$^2$ on a dry basis.

Coating Liquid for Receptive Layer

| | |
|---|---|
| Vinyl chloride-vinyl acetate copolymer | 40 parts |
| Acrylic silicone | 1.5 parts |
| Methyl ethyl ketone | 50 parts |
| Toluene | 50 parts |

Next, a 38 μm-thick polyethylene terephthalate film (Lumirror, manufactured by Toray Industries, Inc.) was provided as a sheet substrate. Register marks were formed on the sheet substrate at its positions as shown in FIG. 3B by gravure printing a register mark ink having the following composition at a coverage of 3 g/m$^2$ on a dry basis.

Register Mark Ink

| | |
|---|---|
| Carbon black | 8.0 parts |
| Urethane resin (HMS-20, manufactured by Nippon Polyurethane Industry Co., Ltd.) | 5.0 parts |
| Methyl ethyl ketone | 38.5 parts |
| Toluene | 38.5 parts |

The transparent sheet provided with the receptive layer was then dry laminated onto the sheet substrate provided with the register marks so that the transparent sheet on its side remote from the receptive layer faced the sheet substrate on its side having the register marks through a resin layer having the following composition (coverage 3 g/m$^2$ on a dry basis) (see FIG. 3C). Further, in the laminate thus obtained, as shown in FIG. 3D, the transparent sheet 2 portion including the receptive layer 3 was subjected to half cutting 7 by pressing an upper die 14 provided with a cutter blade 16 toward a pedestal 15. Thus, a continuously wound intermediate transfer recording medium having alternately the patch portion 6 surrounded by the half cut 7 as shown in FIGS. 1A and 1B of Example 1 was prepared. The resin layer was separable from the transparent sheet.

Coating Liquid for Resin Layer (Easy-adhesion Adhesive Layer Type)

| | |
|---|---|
| Acrylic resin latex (LX 874, manufactured by Nippon Zeon Co.) | 30 parts |
| Water | 35 parts |
| Isopropyl alcohol | 35 parts |

Example 2

A receptive layer was provided on a transparent sheet in the same manner as in Example 1. Separately, a 38 μm-thick polyethylene terephthalate film (Lumirror, manufactured by Toray Industries, Inc.) was provided as a sheet substrate. A resin of low density polyethylene (LDPE) with 15% of titanium oxide being dispersed therein was extrusion coated on the sheet substrate to a thickness of 40 μm. Simultaneously with the extrusion, the transparent sheet with the receptive layer formed thereon was EC laminated onto the sheet substrate with the resin layer formed thereon so that the transparent sheet on its side remote from the receptive layer faced the LDPE layer provided on the sheet substrate. In this case, however, as shown in FIG. 3C, register marks were previously printed by register mark ink as used in Example 1 in the same manner as in Example 1 on the sheet substrate in its side where the LDPE layer was to be formed.

Further, in the laminate thus obtained, as shown in FIG. 3D, the transparent sheet portion including the receptive layer was half cut with the shape as shown in FIG. 2 by pressing an upper die provided with a cutter blade toward a pedestal. In addition, the whole portion except for the patch portion was previously separated using the half cut as the boundary between the removal portion and the image forming portion remaining unremoved. Thus, a continuously wound intermediate transfer recording medium of Example 2 was prepared. This intermediate transfer recording medium was separable in its portion between the resin layer and the transparent sheet.

Comparative Example 1

A peel layer having the following composition was formed on a 25 $\mu$m-thick polyethylene terephthalate film (Lumirror, manufactured by Toray Industries, Inc.) at a coverage of 1 g/m$^2$ on a dry basis. The coating liquid for a receptive layer used in Example 1 was coated onto the peel layer to form a receptive layer at a coverage of 3 g/m$^2$ on a dry basis. Further, an adhesive layer having the following composition 1 was formed on the receptive layer at a coverage of 3 g/m$^2$ on a dry basis. Thus, a receptive layer transfer sheet was prepared. Separately, the coating liquid for a peel layer used in the preparation of the receptive layer transfer sheet was coated on a 25 $\mu$m-thick polyethylene terephthalate film (Lumirror, manufactured by Toray Industries, Inc.) to form a peel layer at a coverage of 1 g/m$^2$ on a dry basis. A protective layer having the following composition was formed on the peel layer at a coverage of 3 g/m$^2$ on a dry basis. An adhesive layer having the following composition 2 was then formed on the protective layer at a coverage of 3 g/m$^2$ on a dry basis. Thus, a protective layer transfer sheet was provided.

Coating Liquid for Peel Layer

| | |
|---|---|
| Polyvinyl alcohol resin (AH-17, manufactured by Nippon Synthetic Chemical Industry Co., Ltd.) | 100 parts |
| Water | 400 parts |

Composition of Coating Liquid 1 for Adhesive Layer

| | |
|---|---|
| Polymethyl methacrylate resin (BR-106, manufactured by Mitsubishi Rayon Co., Ltd.) | 100 parts |
| Foaming agent (F-50, manufactured by Matsumoto Yushi Seiyaku Co., Ltd.) | 15 parts |
| Titanium oxide (TCA-888, manufactured by Tohchem Products Corporation) | 100 parts |
| Methyl ethyl ketone/toluene (weight ratio = 1/1) | 300 parts |

Coating Liquid for Protective Layer

| | |
|---|---|
| Vinyl chloride-vinyl acetate copolymer (VYHD, manufactured by Union Carbide Corporation) | 100 parts |
| Methyl ethyl ketone/toluene (weight ratio = 1/1) | 400 parts |

Composition of Coating Liquid 2 for Adhesive Layer

| | |
|---|---|
| Acrylic resin (BR-106, manufactured by Mitsubishi Rayon Co., Ltd.) | 100 parts |
| Methyl ethyl ketone/toluene (weight ratio = 1/1) | 300 parts |

An image was formed on the receptive layer in the samples provided in the examples and the comparative examples under the following conditions. For the sample provided in Comparative Example 1, a protective layer was further stacked on the image-receptive layer. A thermal transfer sheet (manufactured by Dai Nippon Printing Co., Ltd.), wherein three color transfer layers for yellow, magenta, and cyan as dye layers had been provided in a face serial manner, and each of the intermediate transfer recording media provided in the respective examples were put on top of each other so that each color transfer layer faced the receptive layer. Recording was then carried out by a thermal head of a thermal transfer printer from the backside of the thermal transfer sheet under conditions of head application voltage 12.0 V, pulse width 16 msec, printing cycle 33.3 msec, and dot density 6 dots/line. Thus, a full-color photograph-like image (a mirror image) of a face was formed in a area larger than a area of the patch portion, that is, like the samples of Example 1 as shown in FIG. 1A and the Example 2 as shown in FIG. 2, on the receptive layer in the intermediate transfer recording medium.

Next, the intermediate transfer recording medium was put on top of a 600 $\mu$m-thick white PET-G sheet (PET-G, DIAFIX PG-W, manufactured by Mitsubishi Plastic Industries Ltd.) as an object so that the receptive layer with the image formed thereon faced the PET-G sheet. A thermal head and a platen roll were pressed against the assembly, and energy was applied to the patch portion under conditions of 160 mJ/mm$^2$ and printing speed 33.3 msec/line (feed pitch 6 lines/mm) to adhere the image-receptive layer to the object. The sheet substrate was then separated. Thus, only the image formed portion could be retransferred onto the object to form an image on the object. Further, for the sample of Examples 1, at the time of the retransfer, the transparent sheet portion was cut in such a state that the half cut served as the boundary between the removal portion and the portion remaining unremoved. As a result, the transparent sheet covered the surface of the image formed portion and thus functioned as an even firm protective layer, whereby fastness properties could be fully imparted to the image. Further, since the transparent sheet portion could be tidily cut at the half cut portion, the protective layer could be simply transferred onto the image with high accuracy.

For the sample of Examples 2, since the whole portion except for the image formed portion was previously separated using the half cut as the boundary between the removal portion and the portion remaining unremoved, at the time of the retransfer, the transparent sheet portion was not cut and covered the surface of the image formed portion and thus functioned as an even firm protective layer, whereby fastness properties could be fully imparted to the image. Further, the protective layer could be transferred onto the image with better accuracy in a simpler manner. In Example 2, the detection mark was detected so that the hologram came within the blank portion 9 in part of the patch portion 6. (See FIG. 2) In the retransfer of the transfer portion in the intermediate transfer recording medium onto the object, the detection mark provided in the intermediate transfer recording medium was detected by the printer side for registration.

For the print prepared in Example 2, the patch portion was not transferred to the hologram portion and the image is not if inferior quality.

For the prints (retransferred) prepared in Example 1 and Example 2, the images had no blank in the edge of the print. Further the image was formed in the whole area with no edge and had good look.

In the sample provided in Comparative Example 1, the same white PET-G sheet as used in the examples was put as an object on top of the receptive layer transfer sheet, and the receptive layer was transferred onto the PET-G sheet by means of a thermal head. Next, the thermal transfer sheet as used in the recording of the intermediate transfer recording medium was put on top of the surface of the receptive layer, and a full-color photograph-like image (mirror image) of a face was formed in the area smaller than the area of the receptive layer transferred on the receptive layer by means of a thermal head under conditions of head application voltage 12.0 V, pulse width 16 msec, printing cycles 33.3 msec, and dot density 6 dots/line. Further, a protective layer was transferred from the protective layer transfer sheet onto the image forming portion through the application of energy by means of the thermal head. Thus, an image was formed on the object.

For the protective layer transferred print prepared in Comparative Example 1, the protective layer was a thin film having a small thickness of several $\mu$m, and, hence, the thermally transferred image lacked in fastness properties. Further, for the print prepared in Comparative Example 1, the image with blank in the edge of the print was formed.

What is claimed is:

1. A method for image formation, comprising the steps of:

using an intermediate transfer recording medium comprising: a sheet substrate provided with a resin layer; and a transparent sheet provided with a receptive layer, the sheet substrate provided with the resin layer having been put on top of the transparent sheet provided with the receptive layer so that the transparent sheet faces the resin layer, forming a transfer image in said receptive layer, then retransferring the transfer image formed in said receptive layer onto an object, half-cutting said transparent sheet including the receptive layer, forming the transfer image in said receptive layer in an area equal to or larger than a whole area of a patch portion surrounded by the half cut, which is transferred when the transparent sheet including receptive layer is retransferred to the object, separating only the patch portion in the transparent sheet including the image-formed receptive layer from said resin layer, and retransferring the separated patch portion with no blank in the edge thereof onto the object.

2. The method for image formation according to claim 1, wherein the patch portion has a size smaller than or equal to the object in its whole area on which an image is to be transferred.

3. The method for image formation according to claim 1, wherein the patch portion has a partially removed portion relative to the object.

4. Intermediate transfer recording medium for use in the method for image formation according to claim 1, comprising the sheet substrate provided with the resin layer; and a transparent sheet provided with a receptive layer, the sheet substrate provided with the resin layer having been put on top of the transparent sheet provided with the receptive layer so that the transparent sheet faces the resin layer, said transfer image being formed in said receptive layer, said transparent sheet including the receptive layer being half-cut, said transfer image being formed in said receptive layer in an area equal to or larger than a whole area of the patch portion surrounded by the half cut, which is transferred when the transparent sheet including receptive layer is retransferred to the object, only said patch portion in the transparent sheet including the image-formed receptive layer being separated from said resin layer, and said separated patch portion with no blank in the edge thereof being retransferred onto the object.

5. The intermediate transfer recording medium according to claim 4, wherein the total width of the intermediate transfer recording medium is larger than the width of the object in its face on which an image is to be transferred.

* * * * *